US005285533A

United States Patent [19]

Chen

[11] Patent Number: 5,285,533

[45] Date of Patent: Feb. 15, 1994

[54] ANTI-LEAKAGE APPARATUS FOR CONTAINERS FOR LIQUID

[76] Inventor: Tai-Chung Chen, 6th Fl., No. 1, Lane 32, Shih Chien Rd., Pan Chiao City, Taipei Hsien, Taiwan

[21] Appl. No.: 9,244

[22] Filed: Jan. 26, 1993

[51] Int. Cl.[5] ..... E03D 5/00

[52] U.S. Cl. ..... 4/415; 137/410; 137/428

[58] Field of Search ..... 4/415; 137/558, 389, 137/400, 410, 428

[56] References Cited

U.S. PATENT DOCUMENTS

| | | | |
|---|---|---|---|
| 3,139,616 | 12/1938 | Foulds | 137/400 |
| 3,574,867 | 4/1971 | Biniores | 137/400 |
| 3,857,358 | 12/1974 | Ward et al. | 137/558 |
| 4,592,098 | 6/1986 | Magnes | 137/389 |
| 4,854,340 | 8/1989 | Pavlik | 4/415 |
| 4,901,377 | 2/1990 | Weir | 4/415 |
| 4,993,086 | 2/1991 | Palmer | 4/415 |
| 5,144,700 | 9/1992 | Martin | 4/415 |

*Primary Examiner*—Henry J. Recla
*Assistant Examiner*—Charles R. Eloshway
*Attorney, Agent, or Firm*—Woodcock Washburn Kurtz Mackiewicz & Norris

[57] ABSTRACT

An anti-leakage apparatus for a toilet tank, consisting of a device for detecting leakage, a device for restraining water from entering the toilet tank in response to the leakage detecting device and a device for mounting the anti-leakage apparatus on the toilet tank.

6 Claims, 2 Drawing Sheets

ANTI-LEAKAGE APPARATUS FOR CONTAINERS FOR LIQUID

BACKGROUND OF THE INVENTION

1. Field of Invention

The present invention relates to an anti-leakage apparatus for toilet tanks.

2. Related Prior Art

Toilet tanks are automatically refilled with water after water is released therefrom. Each toilet tank has an input valve and an output valve. The level of water contained in the toilet is initially retained at a highest point. At this instant, the input and output valves are both shut. Once the output valve is opened for releasing water out of the toilet tank for flushing, the input valve is automatically opened for refilling the toilet tank with water. Although water is filled into and released out of the toilet tank synchronously, water decreases in the toilet tank as the rate of flow passing through the input valve is much slower than the rate of flow passing through the output valve. That is, the level of water contained in the toilet tank gets lower. The output valve is shut again when the level of water contained in the toilet tank reaches a lowest position. At this instant, the input valve is still open for refilling the toilet tank with water so that the level of water contained in the toilet tank gets higher. The input valve is shut when the level of water contained in the toilet reaches the highest point again. Normally, those functions should take place automatically, except for opening the output valve. That is, the toilet tank is no longer manually monitored after the output valve is opened. However, the input valve will always be opened for inducing water into the toilet tank when the output valve cannot be properly shut again. Such a leakage might cause a serious waste of water. Therefore, the present invention is intended to solve the above-mentioned problem by providing an anti-leakage apparatus.

SUMMARY OF THE INVENTION

It is an object of the present invention to provide an anti-leakage apparatus for toilet tanks.

It is another object of the present invention to provide an anti-leakage apparatus which closes an input valve in a toilet tank if the level of water contained in the toilet tank are maintained lower than a predetermined position longer than a predetermined period of time.

For a better understanding of the present invention and objects thereof, a study of the detailed description of the embodiments described hereinafter should be made in relation to the accompanying drawings.

DETAILED DESCRIPTION OF THE PREFERRED EMBODIMENT

Figure 1:
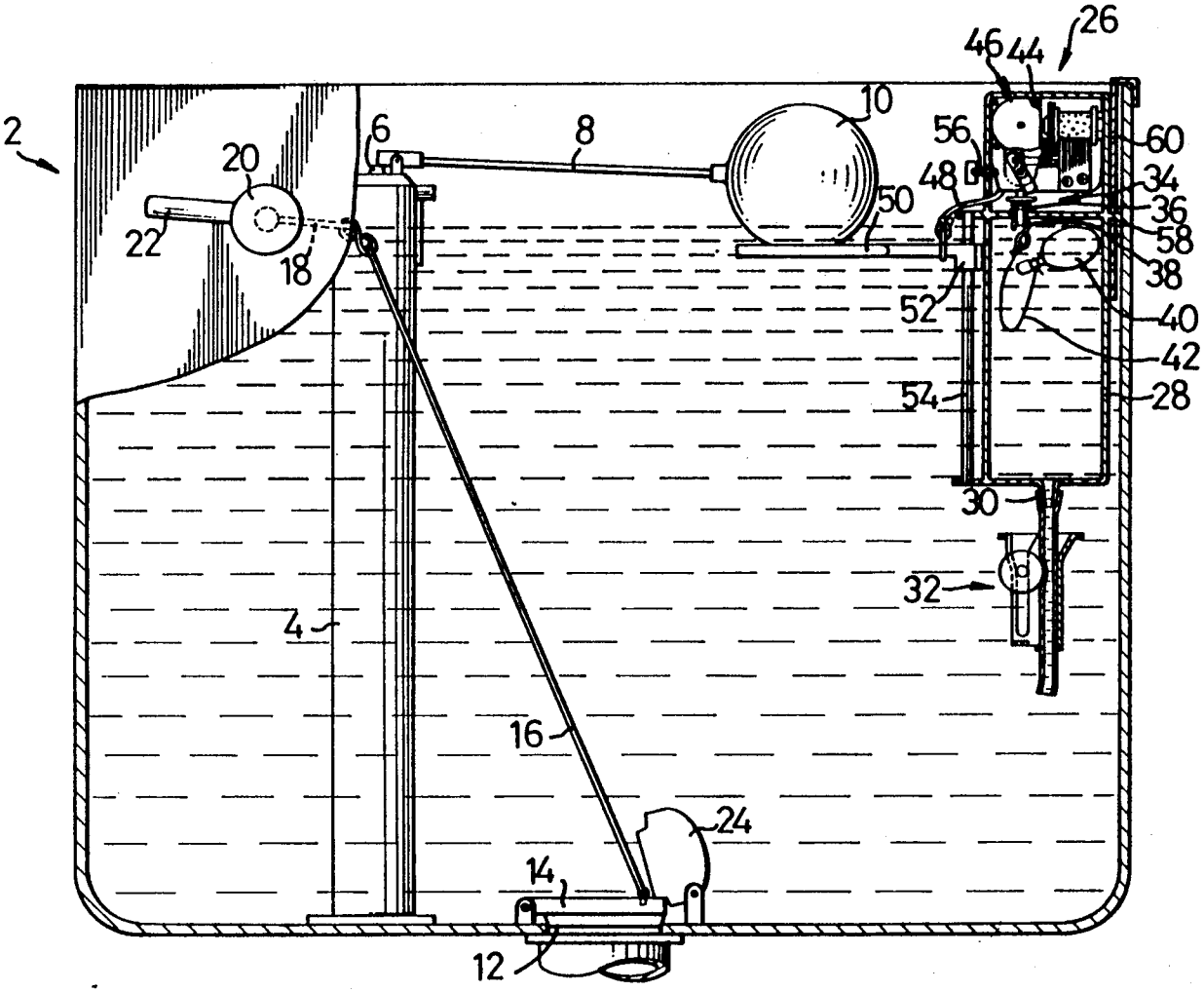
FIG. 1 is a cross-sectional view of an anti-leakage apparatus in accordance with a first embodiment of the present invention, mounted in a toilet tank.

Referring to FIG. 1, a conventional toilet tank 2 is shown in a cross-sectional view. The toilet tank 2 has a tube 4 penetrating a bottom thereof for inducing water therein. The tube 4 can be sealed by means of a valve 6 mounted on top of the tube 4. The valve 6 can be activated by means of a lever 8 pivotably mounted on top of the tube 4. The lever 8 is manipulated by means of a float ball 10. As shown in FIG. 1, the level of water contained in the toilet tank 2 is retained in the highest point. The float ball 10 floats on water contained in the toilet tank 2. The tube 4 is shut by means of the valve 6 activated by means of the lever 8 manipulated by means of the float ball 10. Water is restrained from entering the toilet tank 2. If the level of water contained in the toilet tank 2 is lower than the highest point, the float ball 10 goes down accordingly so as to pivot the lever 8 so as to activate the valve 6 so as to open the tube 4. Water is permitted to enter the toilet tank 2.

The toilet tank 2 has a hole formed in a bottom thereof for releasing water therefrom for flushing a toilet bowl (not shown). The hole 12 can be sealed by means of a valve 14 mounted thereover. The valve 14 is linked to a string 16 further linked to a lever 18. The lever 18 is transversely linked to a shaft 20 penetrating a front wall of the toilet tank 2. The shaft 20 is linked to a handle 22. The hole 12 is opened by means of the valve 14 pivoted by means of the string 16 pulled by means of the lever 18 rotated by means of the shaft 20 when the handle 22 is manipulated. A trap 24 is pivotably mounted on the bottom of the toilet tank 2 for maintaining the hole being opened by trapping the valve 14, until the level of water contained in the toilet tank 2 is lower than the center of gravity of the trap 24.

Normally, the valves 6 and 14 are shut. The handle 22 is initially manipulated in operation. Thus, the hole 12 is opened. The hole 12 is maintained to be opened as the valve 14 is trapped by means of the trap 24. Water flows out of the toilet tank 2 through the hole 12, i.e., the level of water contained in the toilet tank 2 gets lower. The valve 6 is accordingly opened. Thus, water enters the toilet tank 2 through the tube 4 when the water flows out of the toilet tank 2 through the hole 12. However, the level of the water contained in the toilet tank 2 gets lower as the rate of water flowing through the tube 4 is much slower than the rate of water flowing through the hole 12. Once the level of water contained in the toilet tank 2 gets lower than the center of gravity of the trap 24, the valve 14 is released from the trap 24, so that the hole 12 is shut by means of the valve 14 again. Thus, as water only enters the toilet tank 2 through the tube 4 without flowing out of the toilet tank 2 through the hole 12, water increases in the toilet tank 2, i.e., the level of water contained in the toilet tank 2 gets higher. Once the level of water contained in the toilet tank reaches the highest point, the tube 4 is shut again.

However, if the bottom of the toilet tank 2 is broken or the valve 14 is broken, the level of water contained in the toilet tank 2 will never reach the highest point, i.e., water will be flowing into the toilet tank 2 while leaking out of the toilet tank 2. This is a waste.

To prevent the above-mentioned potential risk, the toilet tank 2 incorporates an anti-leakage apparatus 26. The anti-leakage apparatus 26 consists of a device for detecting leakage of water out of the toilet tank 2, a device for restraining water from entering the toilet tank 2 and a device for mounting the anti-leakage apparatus 26 in the toilet tank 2.

The detecting device has a cylinder 28 enclose by a periphery, a top and a bottom. The periphery of the cylinder 28 defines a hole preferably aligning with the highest point of the level of water contained in the toilet tank 2 when the cylinder 28 is mounted in the toilet tank 2. The bottom of the cylinder 28 forms a tube 30 communicating with an adjustor 32 for adjusting the rate of water flowing through the tube 30. In a preferred embodiment of this invention, the adjustor 32 is identical to those used in drip feeds and, therefore, details thereof are not given. The top of the cylinder 28 defines a hole. A switch 34 has an enlarged middle portion from which upper and lower tips oppositely extend. The lower tip of the switch 34 is co-axially inserted through a helical spring 36 and the hole defined in the top of the cylinder 28. The lower tip of the switch 34 defines a hole through which a hook 38 protrudes, so that the helical spring 36 is firmly sandwiched between and compressed by means of the enlarged middle portion of the switch 34 and the top of the cylinder 28. The hook 38 connects with a float ball 40 by means of a string 42.

The device for restraining water from entering the toilet tank 2 has a housing 44 formed on the cylinder 28, for containing a power source 46. The power source 46 is identical to those used in music boxes and, therefore, detailed description thereof will not be given. However, the power source 46 has a spiral spring (not shown) for storing power, a shaft (not shown) operatively connecting with the spiral spring, a pulley securely co-axially mounted on the shaft and a rotor operatively connecting with the spiral spring by means of a gear-and-worm assembly. It should be known the pulley always rotates synchronously with the rotor. A string 48 is operatively linked to and wound about the pulley. The string 48 is induced through a hole defined in the housing 44 so as to be attached to a fork 50. The fork 50 integrates with a sleeve 52 slidably collaring a column 54 vertically supported by two lugs formed on the periphery of the cylinder 28. Thus, the string 48 can pull the fork 50 upward along the column 54. The sleeve 52 integrates with a strip configured corresponding to the periphery of the cylinder 28, for restraining the fork 50 from rotating about the column 54. Two prongs of the fork 50 bear the float ball 10. A security threaded bolt 56 engages in a threaded hole defined in the housing 44.

The mounting device consists of a hook 58 formed on the cylinder 28 and a ladder 60. The ladder 60 has two rods having hooked tips for hooking on a wall of the toilet tank 2 and a number of bars transversely connecting the rods with each other The hook 58 can hook on different bars of the ladder 60 so that the position of the anti-leakage apparatus 26 within the toilet tank 2 can be adjusted.

In operation, the string 48 is unwound from the pulley so that the spiral spring is loaded with power. The fork 52 can accordingly be sited in a lowest position along the column 54. The security threaded bolt 56 is moved into the housing 44 so that its tip restrains the rotor of the power source 46 from rotating, i.e., restrains the spiral spring from retracting the string 48 on the pulley. Water enters the cylinder 28 through the hole defined in the periphery thereof. The security threaded bolt 56 will not be moved out of the housing 44 until the float ball 40 floats on water contained in the cylinder 28 so that the helical spring 36 urges the upper tip of the switch 34 upward so as to restrain the rotor from rotating, i.e., so as to restrain the spiral spring from retracting the string 48.

When water is released out of the toilet tank 2 for flushing the toilet bowl, the level of water contained in the toilet tank 2 gets lower. At that instant, water drips out of the cylinder 28 through the adjuster 32. If leakage happens to the toilet tank 2, the level of water contained in the toilet tank 2 will always be lower than it should be. The float ball 40 goes down as the level of water contained in the cylinder 28 gets lower. When the float ball 40 is suspended, the weight of the float ball 40 pulls down the switch 36. The rotor is released from the upper tip of the switch 36. The spiral spring is permitted to retract the string 48 on the pulley. The fork 50 is pulled upward. The float ball 10 is lifted. The tube 4 is shut when the float ball 10 is lifted to a certain extent. Water is restrained from entering the toilet tank 2. During the process that the float ball 10 is lifted, the power source 46 produces music of warning of leakage. The apparatus 26 can be prepared for further uses as the string 48 can be pulled from the pulley again.

Figure 2:
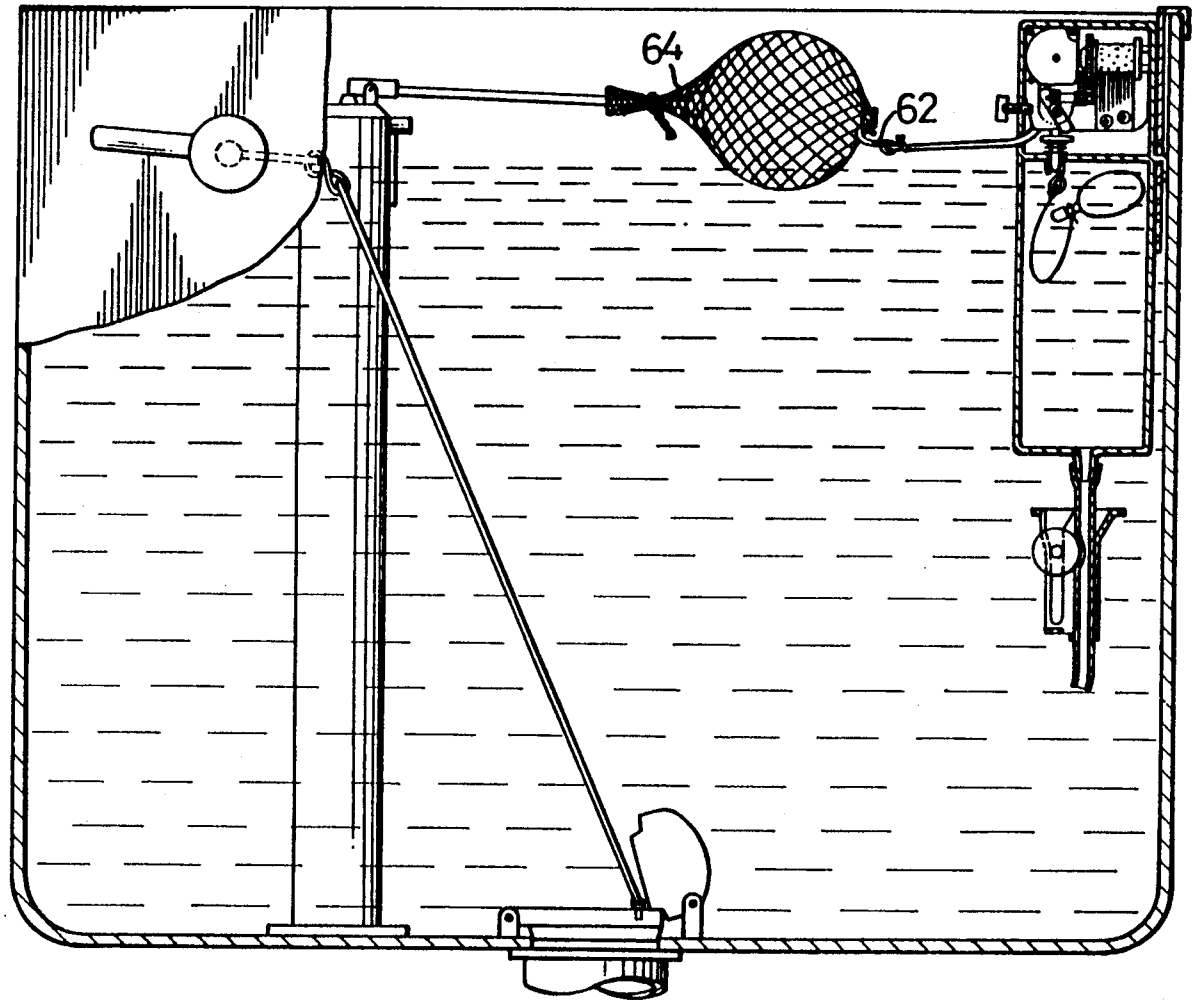
FIG. 2 is a cross-sectional view of an anti-leakage apparatus in accordance with a second embodiment of the present invention, mounted in a toilet tank.

Additionally referring to FIG. 2, in accordance with a second embodiment of the present invention, the device for restraining water from entering the toilet tank 2 consists of a hook 62 and a net 64. The hook 62 is securely attached to the string 48. The net encloses the float ball 10. The hook 62 hooks the net 64. The float ball 10 is pulled upward when the string 48 is retracted.

While the present invention has been explained in relation to its preferred embodiments, variations thereof will be apparent to those skilled in the art. The claims will cover all such variations.

I claim:

1. An anti-leakage apparatus for a toilet tank, comprising:

leakage-detecting means comprising:

a cylinder comprising a periphery defining a hole for permitting water to flow into said cylinder, a top defining a hole and a bottom defining a hole for permitting water to flow out of said cylinder;

a switch comprising a relatively large middle portion from which a first tip and a second tip extend in opposite directions;

a spring through which said second tip extends, said second tip further extending through said hole defined in said top; and a float ball lined to said second tip of said switch by means of a flexible element;

said switch being retained in a first position when said float ball floats on water contained in said cylinder and being pulled to a second position when said float ball is suspended when said cylinder is empty of water; and means for restraining water form entering the toilet tank in response to said leakage detecting means; and means for mounting said anti-leakage apparatus on the toilet tank.

2. An anti-leakage apparatus in accordance with claim 1, wherein said means for restraining water from entering the toilet tank comprises:

a power source responding to said leakage detecting means; and a lifter driven by said power source for lifting a float mounted in the toilet tank.

3. An anti-leakage apparatus in accordance with claim 1, further comprising an adjuster linking to said bottom of said cylinder for controlling the rate of water flowing through said hole defined in said bottom of said cylinder.

4. An anti-leakage apparatus in accordance with claim 1, wherein said means for restraining water from entering the toilet tank comprises:

a power-storing spring;

a pulley linked to said power-storing spring;

a string linked to said pulley so that said power-storing spring is pre-tensioned for winding said string about said pulley;

a rotor rotating synchronously with said pulley through a transmission assembly so that said first tip of said switch restrains said rotor from rotating when said switch is in said first position and that said first tip of said switch releases said rotor when said switch is in said second position, said pulley being restrained from rotating when said rotor is restrained from rotating; and a lifter operatively linked to said string for lifting the float ball mounted in said toilet tank.

5. An anti-leakage apparatus in accordance with claim 4, wherein said lifter comprises:

a column vertically attached to said cylinder; and a fork linking to said string and comprising:

a sleeve integrating therewith for collaring said column so that said fork is slidable along said column; and two prongs for bearing the float ball mounted in the toilet tank.

6. An anti-leakage apparatus in accordance with claim 5, wherein said lifter comprises a net enclosing the float ball mounted in the toilet tank and a hook hooking said net and linking to said string.

* * * * *